United States Patent [19]

Wada et al.

[11] Patent Number: 4,568,169

[45] **Date of Patent: * Feb. 4, 1986**

[54] BOTH SURFACE RECORDING SYSTEM

[75] Inventors: Kenichi Wada, Osaka; Mikio Masui, Hyogo; Masaya Ogawa, Osaka, all of Japan

[73] Assignee: Minolta Camera Kabushiki Kaisha, Osaka, Japan

[ * ] Notice: The portion of the term of this patent subsequent to Jun. 12, 2001 has been disclaimed.

[21] Appl. No.: 703,463

[22] Filed: Feb. 21, 1985

Related U.S. Application Data

[63] Continuation of Ser. No. 399,966, Jul. 19, 1982, abandoned.

[30] Foreign Application Priority Data

| | | | |
|---|---|---|---|
| Jul. 30, 1981 | [JP] | Japan | 56-119926 |
| Jul. 30, 1981 | [JP] | Japan | 56-119927 |
| Jul. 30, 1981 | [JP] | Japan | 56-119928 |
| Jul. 30, 1981 | [JP] | Japan | 56-119929 |

[51] Int. Cl.[4] ..... G03G 21/00

[52] U.S. Cl. ..... 355/3 SH; 271/186; 271/301; 355/14 SH

[58] Field of Search ..... 355/3 R, 3 SH, 14 SH; 271/3.1, 65, 186, 301

[56] References Cited

U.S. PATENT DOCUMENTS

| | | | |
|---|---|---|---|
| 3,615,129 | 10/1971 | Drawe et al. | 271/65 X |
| 4,098,551 | 7/1978 | Komori et al. | 355/3 R |
| 4,210,319 | 7/1980 | Hynes | 271/3.1 |
| 4,359,217 | 11/1982 | Roller et al. | 271/186 |
| 4,453,819 | 6/1984 | Wada et al. | 271/186 X |

*Primary Examiner*—Fred L. Braun

*Attorney, Agent, or Firm*—Watson, Cole, Grindle & Watson

[57] ABSTRACT

A copy machine having an image forming section includes a paper transport passage to such section, a turn-over guide portion which turns over the sheet formed and recorded with an image on its one surface for feeding-in, and a sheet return for returning the sheet formed and recorded with the image on its one surface, from a paper discharge section towards the turn-over guide portion. And, with each one sheet or n (n≧2) sheets being set as one group, each of the sheets recorded on its one surface per each group, is returned to the paper feeding transport passage for effecting image formation and recording onto its other surface. The sheet returning speed is set to be either faster than the ordinary transport speed at the image forming section or to be variable so as to eliminate a loss in time during recording to the other surface of the sheet after recording onto the one surface thereof.

4 Claims, 5 Drawing Figures

BOTH SURFACE RECORDING SYSTEM

This application is a continuation, of application Ser. No. 399,966, filed July 19, 1982,now abandoned.

BACKGROUND OF THE INVENTION

The present invention generally relates to a recording system and more particularly, to a double-side or both surface recording system (referred to as a both surface recording system hereinbelow) arranged to form and record required images on both surfaces of each sheet such as a copy paper sheet, by a recording apparatus having an image forming section for forming and recording the image on one surface of the sheet.

Conventionally, in a copying apparatus and the like, there have been proposed, for example in U.S. Pat. No. 4,098,551 (Komori et al., dated July 4, 1978), a system arranged to form and record images on opposite or both surfaces of one sheet. The known system as described above is so arranged that, with an intermediate tray being disposed between a paper feed cassette and a paper discharge tray, a large number of sheets fed from a paper feed section to an image forming section, and each having an image formed and recorded on its one surface, are once stacked on the intermediate tray for storing, and after completion of the recording on the surfaces thereof, the sheets thus accommodated on the intermediate tray are fed back again to the image forming section so as to effect image formation and recording on their reverse surfaces for carrying out the both surface recording.

In the conventional arrangement as described above, however, the apparatus tends to be large in size, since the intermediate tray must be disposed between the paper feed cassette and the paper discharge tray for effecting the both face recording. Moreover, between the respective sheets after the surface recording and stacked on the intermediate tray, an electrostatic attracting force arising from corona charging in a transfer process during the surface recording is exerted, and therefore, during delivery of the sheets after the surface recording, from the intermediate tray one sheet at-a-time through feeding rollers, there is a possibility that the sheets are undesirably piled one upon another, and thus, two or more sheets are forwarded at the same time. Accordingly, some means for sufficiently erasing the charge on the sheets stacked on the intermediate tray is required, thus resulting in a further increase in the size of the apparatus on the whole.

Moreover, after once being stacked for storage on the intermediate tray, the sheets after the one or front surface recording are successively fed out, at-a-time, from either the top or bottom of the stack for being subjected to image formation on the remaining reverse surfaces thereof, and thus, sequence control for the both surface recording becomes undesirably complicated, while simultaneously, a loss in time may result during changeover between the recording for the front surface and the recording for the reverse surface.

Furthermore, since pressure is applied by the feeding rollers, with respect to the sheets formed and recorded with the image on the front surfaces, and stacked on the intermediate tray, there may arise such a disadvantage that the reverse surface of each sheet at the pressurized portion is soiled by the image formed on the front surface of a subsequent sheet located thereunder in the stack.

SUMMARY OF THE INVENTION

Accordingly, it is a primary object of the present invention to provide a both surface recording system which is so arranged that in a copying apparatus, recording apparatus or the like equipped with a series of a paper feed section, an image forming section and a paper discharge section, there are provided a sheet return and a turn-over guide portion which return each sheet formed and recorded with the image on its one surface, to a sheet transport passage between the paper feed section and the image forming section, from the paper discharge section, and turn over the sheet for feeding into the image forming section, and the image formation and recording with respect to one surface of each sheet are continuously effected for n ($n \geqq 2$) sheets, while each of the sheets after having been recorded, on its one surface is turned over by the sheet return and the turn-over guide portion, so that its other surface serves as an image forming surface, and is supplied into the image forming section subsequent to the nth sheet fed from the paper feed section to the image forming section. In the above arrangement intended to form and record images on the other surfaces of n sheets after having been recorded on the front surfaces, the n sheets are set as one group, and the both surface recording functions are repeatedly effected for each of the groups of sheets so as to substantially eliminate the disadvantages in the conventional arrangements as described earlier.

Another object of the present invention is to provide a both surface recording system of the above described type which is so arranged that, in a printer or the like equipped with the sheet return and the turn-over guide portion as described above, each of the sheets fed from the paper feed section to the image forming section, and subjected to the image formation and recording on its surface is turned over and fed to the image forming section through the sheet entering mechanism and the turn-over guide portion, so that the other surface thereof is rendered to be the image forming surface for effecting image formation and recording on the other surface subsequent to the image formation and recording on its one surface. By the above arrangement, both surface recording onto a large number of sheets can be continuously effected, with a substantial elimination of drawbacks in the conventional system of this kind.

A further object of the present invention is to provide a both surface recording system of the above described type which is so arranged that, the transport speed of the sheet return which returns in a turned over state, the sheet after having been recorded on its one surface, from the paper discharge section to the sheet transport passage between the paper feed section and the recording section through the turn-over guide portion, is set to be faster or higher than the transport speed of the sheet transport passage leading from the paper feed section to the paper discharge section so as to avoid the disadvantages in the conventional systems in which the sheets after the one surface recording must be one stacked for recording, with a consequent elimination of the loss of time in the course from the image formation and recording on one surface to the other surface of each sheet.

A still further object of the present invention is to provide a both surface recording system of the above described type which is so arranged that, with the n sheets set as one group, the both surface recording functons are repeatedly effected, while the transport speed of the sheet return is rendered to be variable according to the information of the selected number of sheets n and the information of sheet size so as to make it possible to set the number of sheets to be recorded on both surfaces in one group (referred to as "group sheet number" hereinbelow) as described, and thus, to provide a both surface recording system effective also for treating remaining sheets with respect to the group sheet number in effecting the both surface recording of a large number of sheets.

DESCRIPTION OF THE PREFERRED EMBODIMENT

Figure 1:
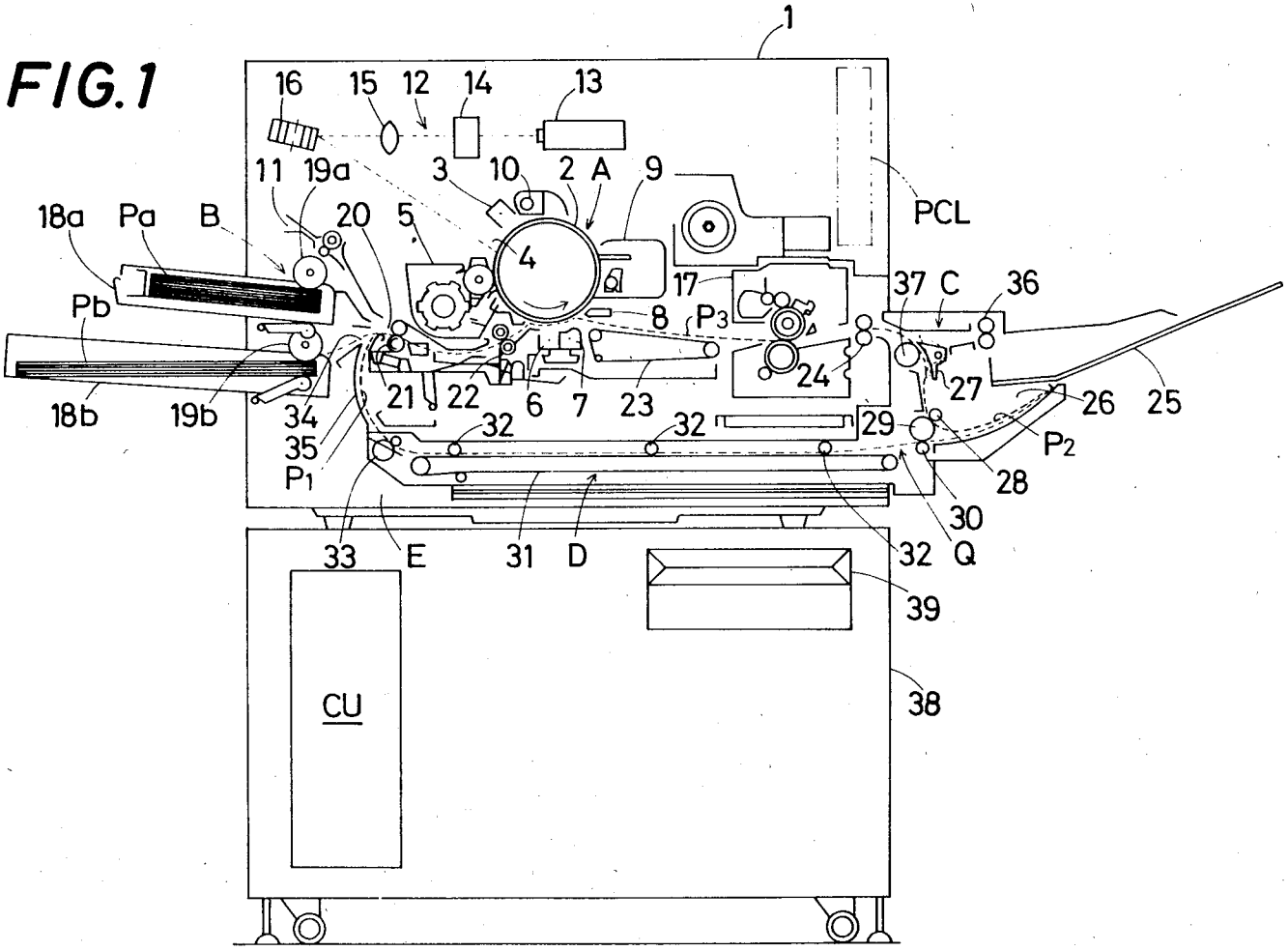
FIG. 1 is a schematic side sectional view of a printer to which the present invention may be applied.

Referring now to the drawings, there is shown, in FIG. 1, a printer to which a both surface recording system according to one preferred embodiment of the present invention may be applied.

In FIG. 1, the printer (1) generally includes a photosensitive or photoreceptor drum (2) provided with a photosensitive or photoconductive surface formed around its peripheral surface, and rotatably provided at approximately the central portion of the printer (1) so as to be driven for rotation in the direction indicated by an arrow. Around the photoreceptor drum (2) as described above, there are sequentially disposed, in a known manner, various processing devices such as a corona charger (3), an exposure slit portion (4), a developing device (5), a transfer charger (6), a separation and erasing charger (7), a separating claw (8), a cleaning device (9), and an eraser lamp (10) in a direction of rotation of the photoreceptor drum (2) so as to successively act on the similar portion of the photoconductive surface of the drum (2) following rotation of said drum, and thus, an image forming section (A) is constituted for transferring a toner image onto a recording paper such as a copy paper sheet which is transported in synchronization with rotation of the photoreceptor drum (2).

In the image forming section (A) as described above, the portion on the photoconductive surface of the drum (2) cleaned by the cleaning device (9) is first erased for discharge by the eraser lamp (10), and subsequently, charged by the corona charger (3).

Onto the surface of the photoreceptor drum (2) thus charged, image information from a laser optical system (12) to be described later is successively projected so as to form an electrostatic latent image (i.e. an image pattern) on the charged surface of the drum (2).

Subsequently, the electrostatic latent image is developed by the developing device (5) into a visible toner image, which is then transferred onto the recording paper transported in a synchronized relation, by the transfer charger (6). The recording paper after the transfer is separated from the surface of the drum (2) by the separation and erasing charger (7) and the separating claw (8).

After the transfer, the surface of the drum (2) from which the recording paper has been separated, is subjected to scraping off of remaining toner by the cleaning device (9), and subsequently, to the charge erasing process by the eraser lamp (10).

The laser optical system (12) referred to earlier is so arranged that a laser beam from a laser (13) is subjected to diffraction by a modulator (14) for on/off control, with a beam diameter being controlled by a lens system (15), while the laser beam passed through the lens system (15) is reflected by a multi-sided mirror (16) rotating at a high speed so as to be projected onto the surface of the drum (2) through an exposure slit portion (4) for forming an image pattern in the form of an electrostatic latent image on the surface of the drum (2) through scanning. It is needless to say that, for the image pattern forming means as described above, various systems conventionally employed may be used, in lieu of the laser optical system described as adopted in the above embodiment.

At the left side of the image forming section (A) in FIG. 1, there is provided a paper feed section (B) which feeds the recording paper into the transfer section, i.e. the portion between the photoreceptor drum (2) and the transfer charger (6), while, at the right side of the image forming section (A), a fixing device (17) for fixing through fusing by heat, the toner image on the recording paper separated from the drum (2) after the transfer, and a paper discharge section (C) for discharging the recording paper passed through the fixing device (17) out of the printer (1) are disposed, so that said paper feed section (B), fixing device (17), and paper discharge section (C) are aligned approximately in one row in the vicinity of the lower portion of the drum (2).

In the paper feed section (B), there are provided paper feeding cassettes (18*a*) and (18*b*) for accommodating therein two kinds of recording paper sheets (Pa) and (Pb) of different sizes, according to the sizes so as to form upper and lower stages in a condition where they extend outwardly from one side of the printer (1), and by selective driving of paper feeding roller (19*a*) or (19*b*) respectively provided for the cassettes (18*a*) and (18*b*), either one of the selected recording paper (Pa) or (Pb) is fed into a paper transport passage (20). The recording paper thus supplied is further fed into the transfer section located under the photoreceptor drum (2) through a pair of intermediate rollers (21) and a pair of timing rollers (22), in synchronization with the movement of the toner image on the surface of the photoreceptor drum (2). In a position above the paper feeding roller (19*a*) for the upper cassette (18*a*), a manual insertion section (11) is provided for feeding the recording paper into the transport passage (20) through insertion by hand.

It is to be noted here that the cassettes (18*a*) and (18*b*) may be of the same size, and that, in the case where sheets of different sizes are separately accommodated therein, size signals for control may be arranged to be obtained from the corresponding cassettes.

The driving of the paper feeding rollers (19*a*) and (19*b*) is effected by transmitting thereto the driving force from a power source (not shown) through a clutch mechanism including a known spring clutch and a solenoid, etc., with a paper feeding timing signal being imparted as functioning timing of the solenoid. Meanwhile, the pair of intermediate rollers (21) are arranged to be stopped at an initial stage so as to once stop the recording paper (Pa) or (Pb) fed from the paper feeding cassette (18*a*) or (18*b*) into the paper transport passage (20), and, by being driven at a proper timing, adapted to forward the recording paper towards the pair of timing rollers (22). The pair of timing rollers (22) are also stopped in the similar manner so as to once stop the recording paper (Pa) or (Pb) fed from the pair of intermediate rollers (21), and are arranged to be started by the timing roller functioning signal output in synchronization with the toner image formed on the photoreceptor drum (2) for feeding the recording paper into the transfer section.

Subsequent to the transfer section, there are provided a transport belt (23) for feeding the recording paper delivered from the transfer section into the fixing device (17), and a pair of discharge rollers (24) for discharging the recording paper fed from the fixing device (17) into the paper discharge section (C).

In the paper discharge section (C), a discharged paper tray (25) for receiving and stacking the discharged recording paper sheets thereon for storage is provided in a manner as described later.

For effecting image formation and recording on the reverse surfaces of the recording paper sheets coming out from the fixing device (17) after the image recording on the front surfaces, there is provided a sheet return (D) for returning the recording paper from the paper discharge section (C) towards the paper transport passage (20) between the paper feed section (B) and the image forming section (A).

Figure 2:
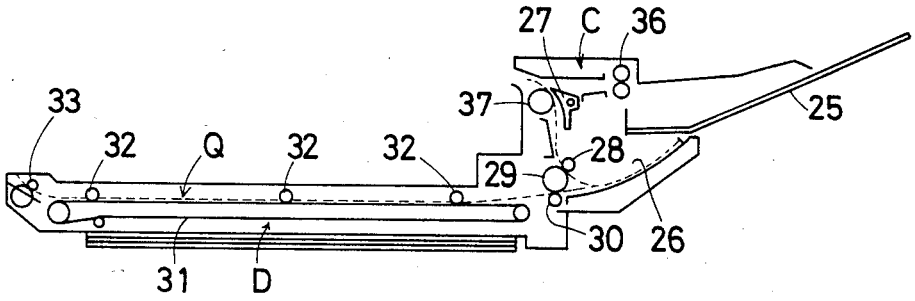
FIG. 2 is a cross sectional view showing, on an enlarged scale, a sheet return employed in the printer of FIG. 1 as detached therefrom.

The sheet return (D) as described above is constructed as shown in FIG. 2 in the form of a unit which is detachably mounted in a flat space (E) formed under the paper feed section (B), image forming section (A) and fixing device (17) in the printer housing (1).

On the end portion of the sheet return (D) extending outwardly from the right side of the printer housing (1), there are provided the paper discharge section (C) detachably mounted with the discharged paper tray (25), a switch-back passage (26) for returning the recording paper sheets discharged from the pair of discharge rollers (24) after recording on the front surfaces thereof by exchanging a leading edge for a trailing edge of each of the sheets through the so-called switch-back system, and a guide claw (27) which is arranged to be changed over for selectively guiding the recording paper sheets discharged from the pair of discharge rollers (24) to either the discharged paper tray (25) or the switch-back passage (26).

The switch-back passage (26) open at its upper portion is shorter in length than the recording paper of the minimum size to be used, and forms a lateral passage including a slightly concave surface. The passage (26) is provided with a set of lead-in rollers (28) and (29) for introducing the recording paper fed downwardly from the guide claw (27) into the lateral passage, and a set of feed-out rollers (29) and (30) which are so arranged that, at the moment when the trailing edge of a recording paper, (which curves at its intermediate portion raised upward through contact, at its leading edge, with the end of the passage so as to be pushed back upon entry of the recording paper into the short lateral switch-back passage (26)) is fed out from the set of lead-in rollers (28) and (29), the trailing edge of the recording paper is fed out to a transport belt (31).

The sheet return (D) further includes a transport belt (31) for returning the recording paper delivered from the set of feed-out rollers (29) and (30) to the course of the paper transport passage (20), a plurality of auxiliary transport rollers (32) rotatably contacting the transport surface of the belt (31), and a set of transport rollers (33), all of which are sequentially disposed from the feed-out rollers (29) and (30) towards the side of the paper transport path (20) to form the returning transport passage.

In a position prior to the pair of intermediate rollers (21) located in the course of the paper transport passage (20), a feed-in port (34) for feeding the recording paper returned by the sheet return (D) into the transport passage (20) is provided. The feed-in port (34) as described above is further provided with a curved recording paper returning and turn-over guide (35) for advancing the recording paper fed out from the transport rollers (33) towards the intermediate rollers (21) of the paper transport passage (20) in the turned-over state. The guide (35) referred to above is secured in the printer housing (1).

The recording paper returned to the paper transport passage (20) is arranged to be transported by the transport rollers (33) until it is held between the intermediate rollers (21), and fed into the transfer section after being subjected to the timing adjustment (i.e. synchronizing adjustment with respect to the toner image on the photoreceptor drum) similar to that previously stated by the pair of intermediate rollers (21) and the pair of timing rollers (22) so as to be transferred with the toner image for recording on its reverse surface which is not formed and recorded with the image as yet.

Figure 3:
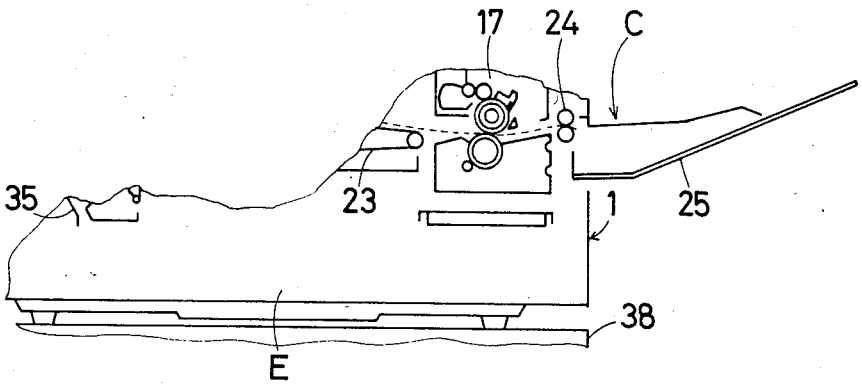
FIG. 3 is a fragmentary side sectional view showing part of a housing of the printer of FIG. 1 from which the sheet return has been detached.

The discharged paper tray (25) is also arranged to be detachable from the sheet return (D), and directly mounted on the printer housing (1) as shown in FIG. 3 when return (D) is removed from the printer housing (1).

At a position before the mounting portion of the discharged paper tray (25) of the sheet return (D), there are provided a pair of auxiliary paper discharge rollers (36), while an auxiliary feeding roller (37) is disposed together with a guide claw (27) at a branching point for the paper discharge passage from the discharge rollers (24) towards the auxiliary paper discharge rollers (36) or the switch-back passage.

At one upper corner portion within the printer housing (1), there is further provided a process control logic (PCL) for sequence control mainly of the mechanical functionings of the printer (1) as indicated by two-dotted chain lines in FIG. 1.

Meanwhile, in a base (38) on which the printer (1) is placed, a control unit (CU) for imparting control signals to the process control logic (PCL), and also for feeding data signals to the laser optical system is dis- posed.

The control unit (CU) is arranged to receive various signals from external computers, word processors, or memory devices such as magnetic discs, etc. (not shown), and by this, the modulation control with respect to the modulator (14) of the laser optical system (12) is effected, while control signals (such as synchronizing signals, etc. with respect to the laser optical system (12)) for the process control logic (PCL) are processed within the control unit (CU) so as to be developed as an output. In the base (38), there are provided a discette (39) mounted on the memory device mentioned earlier for feeding signal to the control unit (CU), and also, connecting portions with external appliances such as external computers, word processors, etc., although these are not particularly shown.

Subsequently, functionings in the case where images are formed and recorded on both surfaces of one recording paper sheet by the printer described earlier will be explained hereinbelow.

Either of the recording paper sheets (Pa) or (Pb) accommodated in the paper feeding cassette (18*a*) or (18*b*) is fed into the paper transport passage (20) by the paper feeding roller (19*a*) or (19*b*). The recording paper sheet is fed into the transfer section between the photoreceptor drum (2) and the transfer charger (6) after synchronization through timing adjustment by the intermediate rollers (21) and timing rollers (22), and is transferred, on its front surface, with the toner image on the photoreceptor drum (2). The sheet is then separated from the surface of the photoreceptor drum (2) by the resiliency of the sheet itself and the separation and erasing charger (7), and is forwarded into the fixing device (17) by the transport belt (23), and at the fixing device (17), the toner image is fixed onto the sheet for completion of image formation and recording onto the front surface of the recording paper sheet.

Each of the recording paper sheets after recording on its front surface is transported to the paper discharge section (C) by the pair of discharge rollers (24), and guided into the switch-back passage (26), since the guide claw (27) has been shifted to the position indicated by dotted lines in FIG. 1 according to the both surface recording instruction with respect to one sheet of the recording paper. In passage (26), the sheet has its leading edge exchanged for the trailing edge thereof, and then, returned to the course of the paper transport passage (20) by the transport belt (31) and auxiliary rollers (32), and the transport rollers (33). In the above returning, the recording paper sheet is turned over by the guide of the feed-in port (34) facing the course of the paper transport passage (20), and is fed into the transfer section between the photoreceptor drum (2) and the transfer charger (6) after the synchronization through timing adjustment by the intermediate rollers (21) and timing rollers (22), and thus, transfer of the toner image is effected onto the reverse surface of the recording paper sheet not yet subjected to the image formation and recording. The recording paper sheet transferred with the toner image on its reverse surface as described above is separated from the drum (2) in the similar manner as in the process after transfer of the toner image on its front surface, and fed to the fixing device (17) through the transport belt (23) for the fixing of said toner image.

The recording paper sheet completed with the both surface recording in the above described manner is discharged into the paper discharge section (C) through the pair of discharge rollers (24). At the paper discharge section (C), since the guide claw (27) has been returned to the solid line position of FIG. 1 by the both surface recording instruction with respect to one sheet of the recording paper, the sheet is guided by the auxiliary paper discharge rollers (36), and discharged onto the discharged paper tray (25) by rollers (36).

Subsequently, description will be given to a case where the both surface recording is continuously effected onto a large number of recording paper sheets.

If the both surface recording is effected one sheet at-a-time, there is a loss of time involved in the processing therefor, thus resulting in a considerable reduction in processing speed. Accordingly, the arrangement is so made that recording onto the front surface is effected by particularly feeding n ($n \geqq 2$) sheets of recording paper continuously, while the recording paper sheets after recording onto the front surfaces are successively fed into the sheet return (D), and, subsequent the front surface recording function for the nth sheet, recording onto the reverse surfaces of n sheets already completed with the recording onto the front surfaces is effected. By repeating the both surface recording for each group, with the n sheets set as one group, the both surface recording with respect to the large number of recording paper is performed.

For example, on the assumption that the both surface recording is to be effected, with the number n of the sheets for one group (referred to as "group sheet number" hereinbelow) being set as 3, the recording paper sheets (P1), (P2) and (P3) are first successively fed from the paper feed section (B) to the image forming section (A) continuously, and the recording onto their front surfaces is continuously effected. Owing to the fact that the guide claw (27) is positioned as shown by the dotted lines in FIG. 1 until the third sheet (P3) of the recording paper after the recording on the surface passes according to the both surface recording instruction by the group sheet number 3, the recording paper sheets (P1), (P2) and (P3) are all returned by the sheet return through the switch-back passage (26), and fed into the paper transport passage (20) in the turned-over state. In other words, image formation and recording onto the reverse surfaces are successively effected. In the case where the both surface recording onto the first sheet (P1) of the recording paper is effected and the sheet is discharged onto the paper discharge section (C) by the discharge rollers (24), the guide claw (27) has been returned to the solid line position in FIG. 1, and thus, the recording paper sheets ($P_1$), ($P_2$) and ($P_3$) after the both surface recording are successively discharged onto the discharged paper tray (25) one sheet after another.

The image pattern projected onto the photoreceptor drum (2) by the laser optical system (12) is predetermined by information such as for front surface, reverse surface, group sheet number n, etc., and is output in such an order. For example, in the case where a continued page item is to be recorded each for one copy at the group sheet number 3, successive output is effected for the first, third and fifth pages with respect to the surface recording of the first group, and for the reverse surface recording, output is successively effected for the second, fourth and sixth pages, while in the second group, output is successively made for the reverse surfaces of the eighth, tenth and twelfth pages, subsequent to the output for the seventh, ninth and eleventh pages for the front surfaces.

Meanwhile, in the case where recording for each three copies is to be performed at the group sheet number 3, output for the first page is effected for all of the recording paper sheets, with respect to the surface recording of the first group, while output for the second page is similarly effected with respect to the reverse surface recording respectively. In the second group, output all for the third page is effected, with respect to the surface recording therefor, while output for the fourth page is similarly effected, with respect to the reverse surface recording.

When the extended length of the recording paper sheet is short in comparison with a length Q of a recording paper both surface recording circulation passage as shown by a dotted line in FIG. 1, as in the case where the group sheet number n is 3, the returning speed of the sheet return should be properly set. By such an arrangement, it becomes possible to feed the first recording paper sheet ($P_1$) after the surface recording into the transfer section, subsequent to the toner image transfer function with respect to the surface of the third recording paper sheet ($P_3$), with a consequent elimination of a loss in time after the front surface recording up to the starting of the reverse surface recording. The quick return system as described above is effective in the case where the group sheet number is small, and is still more effective for the both surface recording with respect to one recording paper sheet.

Figure 4:
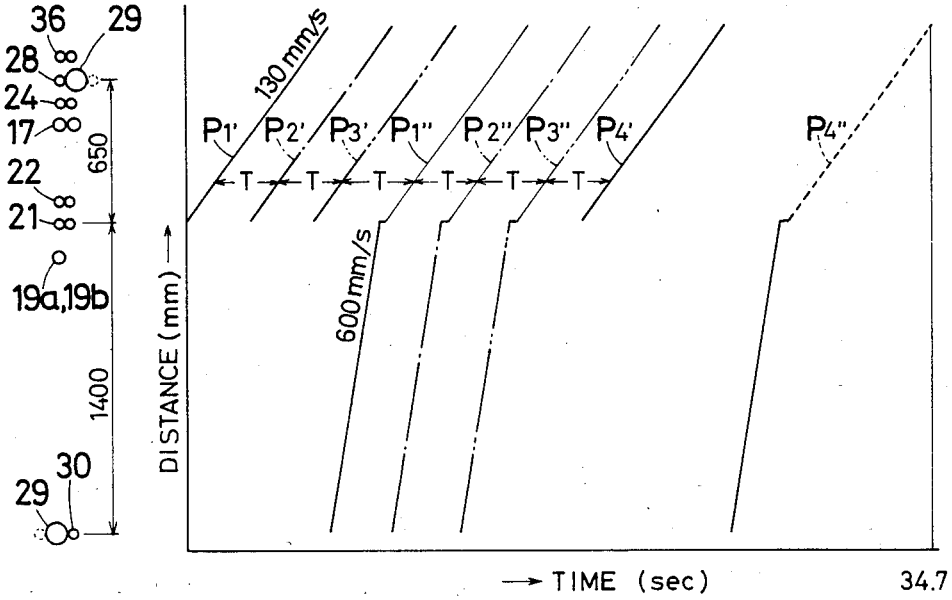
FIG. 4 is a graph showing examples of sheet processing transport speeds in the both surface recording system according to the present invention.

Reference is made to FIG. 4 showing one example for setting the both surface recording processing speed with respect to the recording paper sheets ($P_1$), ($P_2$) and ($P_3$) in the case where the group sheet number is set to be 3.

More specifically, in FIG. 4, there is shown a case where, with respect to the ordinary recording processing speed of 130 mm/s, the recording paper sheet returning speed from the feed-out rollers (29) and (30) at the switch-back passage (26) to the intermediate rollers (21) in the course of the paper transport passage (20) is set at 600 mm/s which is approximately 4.6 times.

It is to be noted here that the above case relates to the conditions where the recording paper sheet size is 210 mm (lateral feeding of JIS A4 sheet), distance between the paper feed rollers (19*a*) and (19*b*) and the intermediate rollers (21) is 100 mm, distance between the intermediate rollers (21) and the lead-in rollers (28) and (29) for the switch-back passage is 650 mm, and returning distance from the feed-out rollers (29) and (30) for the switch-back passage up to the intermediate rollers (21) is 1400 mm.

By the above arrangement, with respect to the fact that the surface recordings ($P_1'$), ($P_2'$) and ($P_3'$) in the group sheet number 3 are succesively effected at an ordinary interval time (T), the reverse surface recording ($P_1''$) for the first sheet is effected through the same time interval time (T) from the third surface recording ($P_3'$), followed by subsequent reverse surface recording ($P_2''$) ($P_3''$) for the second and third sheets, and therefore, time loss for the both surface recording is completely eliminated.

If the number of sheets required for the both surface recording is of an integer multiple of the group sheet number n, the group system both surface recording may be repeated by the times equivalent to the multiple, but in the case where the relation is (integer multiple of n) + (number smaller than the group sheet number n), the both surface recording of the group system is effected for the integer multiple portion, while the both surface recording for each sheet is effected for the remaining number of sheets smaller in number than the group sheet number n.

By way of example, on the assumption that the number of sheets required for the both surface recording is 4, with the group sheet number being set at 3, as shown at ($P_4'$) in FIG. 4, after completion of the both surface recording by the group system for one time, recording onto the front surface of the fourth recording sheet is effected at the ordinary recording processing time interval, and subsequently, after the predetermined recording processing time with respect to the reverse surface for one time including the quick return processing, recording to the reverse surface of the fourth recording paper sheet is terminated as shown at ($P_4''$).

In the above case, as is clear from FIG. 4, a loss of time may result in the interval between the recording onto the front surface of the fourth recording paper sheet and the recording to the reverse surface thereof. In connection with the above, although it is possible to effect the both surface recording processing with respect to the both surface recording for the remaining sheets in number smaller than the group sheet number, a loss in time may also be involved in the above case, corresponding to the number of the remaining sheets with respect to the group sheet number.

For elimination of the above inconvenience, it may be so arranged that the both surface recording for the required number of sheets is completed by the group system both surface recording processing, without any excess or deficiency in number. For this purpose, the group sheet number is first arranged to be set as desired. Subsequently, in the respective group sheet numbers set as desired, the return speed of the recording paper sheet is arranged to be variable according to the size of the recording paper sheet and the group sheet number so that, immediately after the completion of the front surface recording for the set group sheet number, the reverse surface recording of the first sheet of the group may be effected.

Figure 5:
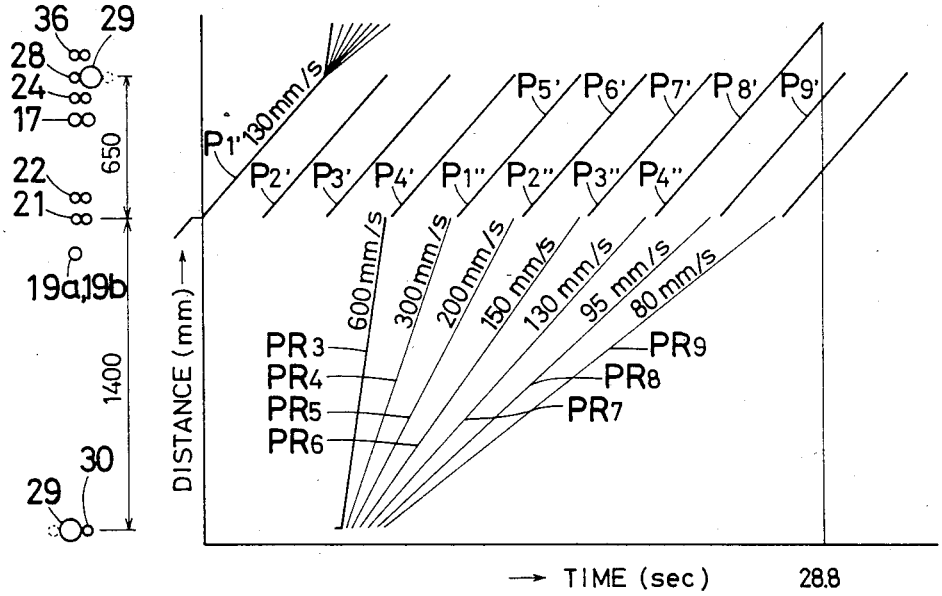
FIG. 5 is a graph similar to FIG. 4, which particularly shows sheet processing transport speeds in another both surface recording system according to the present invention.

FIG. 5 shows one example for setting the return speed corresponding to the respective set group sheet number, in the case where the recording paper return speed is set to be variable, in which, except that the return speed is made variable, the conditions are the same as in FIG. 4.

The return speed is set at the same 600 mm/s as in FIG. 4 up to the group sheet number of 3 sheets, while, when the group sheet number is 4 sheets, it is set at 300 mm/s, and for the group sheet number of 5 sheets, at 200 mm/s, for the group sheet number of 6 sheets, at 150 mm/s, for the group sheet number of 7 sheets, at 130 mm/s, for the group sheet number of 8 sheets, at 95 mm/s, and for the group sheet number of 9 sheets, it is set at 80 mm/s so as to be varied following the increase of the group sheet number n as shown at ($PR_3$), ($PR_4$). . ., and ($PR_9$) in FIG. 5, and after the recording ($P_4'$), ($P_5'$) . . ., and ($P_9'$) for the front surface of the set group sheet number the recording on the reverse surface of the first sheet of said gorup is immediately effected.

On the assumption that the group sheet number is 4, immediately after the surface recording of the 4 sheets proceeds in the order of ($P_1'$), ($P_2'$), ($P_3'$) and ($P_4'$), recording onto the reverse surfaces ($P_1''$), ($P_2''$), ($P_3''$), and ($P_4''$) is successively effected, and thus, the both surface recording onto the four sheets is completed. The time required for the above process is about 29 seconds, which is a marked reduction with respect to approximately 35 seconds required for the both surface recording of 4 sheets in the case where the sheet number n is fixed at 3, and the last one sheet is independently recorded for both surfaces.

It is to be noted here that in the ordinary recording apparatus, excessive increase of the number of sheets present within the machine is not desirable upon consideration of the after treatment when troubles take place. Therefore, in the case where the required number of recording paper sheets is 9, it is preferable to set the sheet number n=3 for repeating three times rather than to set the group sheet number n=9. Moreover, also in the case where the return speed is set to be variable, with the group sheet number being also set to be variable, it is preferable that the number of steps for variations of the speed is arranged to be smaller.

Accordingly, for example, in a machine in which the basic group sheet number n=2, the remaining number during the recording is either 0 or 1, and therefore, it may be so arranged that a speed variation mechanism which renders the last block sheet number to be n=3 is provided, and in a machine with a basic group sheet number n=3, since the remaining number is similarly 0, 1 or 2, a speed variation mechanism which is capable of establishing relations n=4 and n=5 may be provided. More specifically, in a machine with the basic group sheet number n=N, if it is so arranged as to make it possible to effect speed variations at the numebr of steps (N steps) up to N ~2N−1, the number of step variations may be effectively reduced.

It is to be noted here that, for the mechanism which makes it possible to render the transport speed variable, known mechanism, for example an arrangement to control the speed, for example, by the use of a DC motor for driving the sheet returning means (D), or an arrangement employing a speed changing mechanism including a combination of a clutch and a gear, etc. may be employed.

By the constructions according to the present invention as described in the foregoing, the intermediate tray for once stacking thereon for storing, the sheets after the front surface recording in preparation for the reverse surface recording as required in the conventional arrangements, may be dispensed with, so as to prevent the increase in size of the apparatus, while owing to the unnecessity for once stacking the sheets after the surface recording, not only the charge erasing with respect to the sheet for the prevention of attraction is not required, but the disadvantage that the reverse surface of the upper side sheet is soiled by the recorded image on the lower side sheet due to depression of the stacked sheets by the paper feeding rollers is also eliminated.

Furthermore, by the arrangement of the present invention in which the front surface recording and the reverse surface recording for each one group is continuously effected through the circulating transport system for successively returning and turning over the sheets after completion of the surface recording, change-over is effected from the surface recording to the reverse surface recording, with simultaneous elimination of the loss in time for effecting the surface recording for the subsequent group, and simplification of the sequence control therefor.

What is claimed is:

1. A both surface recording system for use in a recording apparatus provided with an image forming section for forming and recording an image on one surface of each sheet supplied from a sheet feeding section, said both surface recording system comprising:

sheet discharging means for selectively discharging the sheet transported from the image forming section to a tray which receives the sheet or to sheet returning means for returning the sheet formed and recorded with the image on one surface to a sheet transport passage between the sheet feeding section and the image forming section;

said sheet returning means including a sheet inverting portion, a sheet returning portion and a turn-over guide portion, said sheet inverting portion having a switch-back passage formed to bend upwardly by degrees and three rollers arranged such that a first and a second roller are both in contact with a third roller on opposite sides thereof and rotate in a direction opposite to that of the third roller, in which the first and third rollers receive the sheet from said sheet discharging means and feed the sheet into the switch-back passage, the switch-back passage causing the sheet to turn back between the second and third rollers as soon as a trailing edge of the sheet completes passing between the first and third rollers, thereby a leading edge of the sheet is exchanged for the trailing edge thereof, and the second and third rollers feed the sheet to the sheet returning portion, said sheet returning portion transporting the sheet received from said sheet inverting portion to said turn-over guide portion and said turn-over guide portion feeding the sheet in a turned-over state to the sheet transport passage for transporting the sheet toward the image forming section, and the sheet after having been formed and recorded on its one surface being fed in said sheet returning means, being each time returned to the sheet transport passage through said sheet returning means so as to be formed and recorded with an image on the other surface thereof and then being discharged onto the tray.

2. A both surface recording system as claimed in claim 1, wherein said sheet return means is capable of a return speed of said sheet set to be higher than a transport speed of the sheet at the image forming section.

3. A both surface recording system as claimed in claim 1, further being so arranged as to be capable of repeatedly effecting the both surface recording successively for every n($2 \leqq n \leqq N$:N is the maximum number of sheets which can be held in said sheet returning means) sheets which are set to be one group, said both surface recording for each group being effected in such a manner that said sheets of said groups are continuously fed from the sheet feeding section to the image forming section, fed in said sheet returning means in order after forming the image on one surface thereof, then returned continuously by said sheet returning means even as succeeding sheets in said group are being recorded with the image and further successively fed into the image forming section subsequent to n-th sheet of said group so as to be discharged onto the tray after having been formed and recorded with an image on the other surface thereof.

4. A both surface recording system as claimed in claim 3 wherein a return speed of said sheet is adapted to be variable according to the information for a selected number of sheets n and the information for size of the sheet.

* * * * *